US006708900B1

(12) United States Patent
Zhu et al.

(10) Patent No.: US 6,708,900 B1
(45) Date of Patent: Mar. 23, 2004

(54) HVLP SPRAY GUN

(75) Inventors: Heping Zhu, Maple Grove, MN (US); Harold D. Johnson, Buffalo, MN (US); Steven P. Plager, Eden Prairie, MN (US); Dale C. Pemberton, Rockford, MN (US); Keith A. Christensen, Mounds View, MN (US); Vicky J. Lubenow, Dablo, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 351 days.

(21) Appl. No.: 09/905,697

(22) Filed: Oct. 25, 2000

(51) Int. Cl.[7] ..... B05B 1/28

(52) U.S. Cl. ..... 239/296; 239/290; 239/291; 239/297; 239/300

(58) Field of Search ..... 239/296, 267, 239/290, 291, 292, 297, 300, 301, 398, 525, 526, 527, 538

(56) References Cited

U.S. PATENT DOCUMENTS

| | | | | | |
|---|---|---|---|---|---|
| 4,386,739 | A | * | 6/1983 | Kwok | 239/296 |
| 5,078,322 | A | * | 1/1992 | Torntore | 239/289 |
| 5,165,605 | A | * | 11/1992 | Morita et al. | 239/296 |
| 5,201,466 | A | * | 4/1993 | Hynds | 239/263 |
| 5,279,461 | A | * | 1/1994 | Darroch | 239/297 |
| 5,803,367 | A | * | 9/1998 | Heard et al. | 239/296 |
| 6,068,203 | A | * | 5/2000 | DeYoung et al. | 239/297 |

* cited by examiner

*Primary Examiner*—Davis D. Hwu
(74) *Attorney, Agent, or Firm*—Douglas B. Farrow

(57) ABSTRACT

An HVLP spray gun includes a coaxial combination air valve assembly 30 for controlling total air flow as well as pattern air flow which is frictionally retained in the gun body 12.

1 Claim, 4 Drawing Sheets

HVLP SPRAY GUN

This application is a C-I-P of U.S. application Ser. No. 60/243,095, filed Oct. 25, 2000.

TECHNICAL FIELD

1. Background Art

HVLP (high volume low pressure) paint spray guns have recently become increasingly popular for providing a high quality finish with good transfer efficiency.

2. Disclosure of the Invention

It is therefore an object of this invention to provide an HVLP spray gun which is easy to use, versatile, provides a high quality finish, and high transfer efficiency.

The spray gun of the instant invention is provided with a long needle guide nay relatively light spraying which enables the gun to have a very low trigger force. The surface on which the nozzle rests and is screwed into is located at the forward most end of the gun body (once the air cap and retaining ring are removed) thereby allowing the nozzle to be easily gripped and mounted or removed from the gun by hand without the need for any tools.

As with most air spray and HVLP guns, an air line extends downwardly out of the gun body to a tube which in turn attaches to a fitting on the top of the paint cup. Located on the inner side of this fitting on the paint cup (inside the paint container) is a polyurethane molded duckbill valve which serves as a check valve to prevent the flow of paint up into the air valve. Such a valve is a substantial improvement on the check valves of prior art devices which tend to become clogged with paint and which are more expensive to manufacture.

An air adjustment valve assembly has two parts—a total airflow adjustment valve and a spray pattern adjustment valve. The total flow valve adjusts exactly what it says—the amount of airflow into the gun for atomizing and spray pattern adjustment while the spray pattern adjustment valve adjusts only the width for the spray pattern. While this is referred to as a spray pattern adjustment, this adjustment is also commonly referred to as fan air or shaping air. The air valve assembly slides into the back of the gun, which enables it to be removed without the need for tools.

On the air cap, a 55° angle between the center hole (the centerline of the gun) and the side holes provides the best spray pattern with a chamfer on the center hole reduces the amount of large droplets at the side of the spray pattern and allows a uniform spray pattern. A radius of 0.015 inches on the front edge of the nozzle allows air to smoothly interface with the liquid flow stream resulting in an improved uniform droplet sized distribution on the spray pattern. Five lengths of nozzles for five different fluid sets allow the gun to use the same air cap with different flows. The nozzle housing is provided with nine 0.1718" holes and eight 0.156" holes to allow air to pass into the air cap.

In the gun body, airflow is divided into two streams by utilizing two separate holes. A 0.35"×0.70" hole with a 48° angle provides air to the air cap center hole for atomization. While the 0.800" hole and a 1.32" slot introduces air to the side holes on the air cap providing fan air.

These and other objects and advantages of the invention will appear more fully from the following description made in conjunction with the accompanying drawings wherein like reference characters refer to the same or similar parts throughout the several views.

BEST MODE FOR CARRYING OUT THE INVENTION

Figure 1:
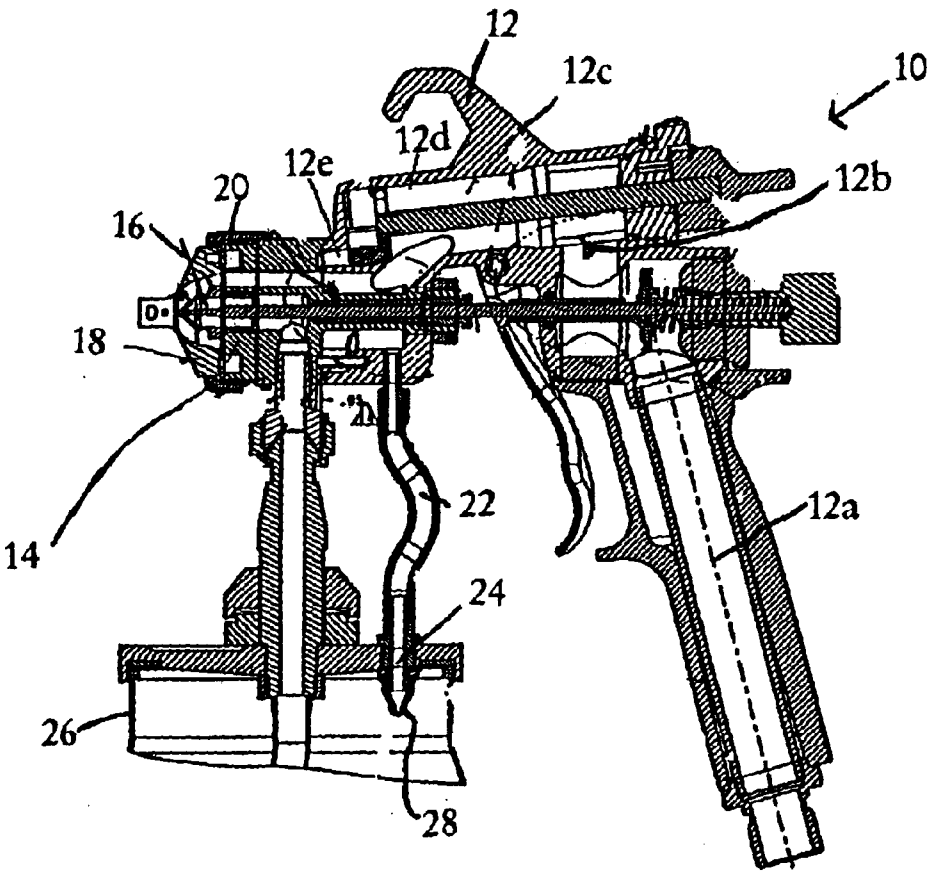
FIG. 1 is a side cross-section view showing the spray gun of the instant invention.

The instant invention generally designated 10 is shown in FIG. 1 and is comprised of a gun body 12, a nozzle housing 14, a nozzle 16, an air cap 18, and a retaining ring 20.

Body 12 has an air inlet chamber 12*a* in the handle which extends upwardly to an opening 12*b* which extends into distribution air chamber 12*c*.

Figure 2:
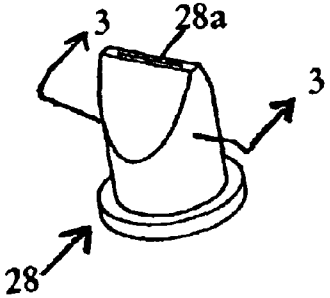
FIG. 2 is a perspective view of the duck bill valve of the instant invention.
Figure 3:
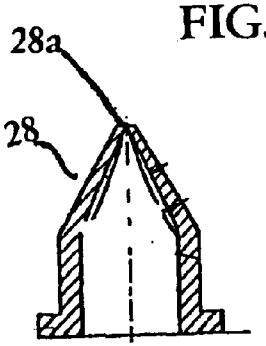
FIG. 3 is a cross-sectional view taken along line 3—3 of FIG. 2.

FIG. 1 also shows a tube 22 extending downwardly from body 12 to a fitting 24 located on the top of spray cup 26. Located on the inner end of fitting 24 is a duckbill valve 28, which is shown in more detail in FIGS. 2 and 3. Duckbill valve 28 is formed from a polyurethane molding material having a hardness in the durometer range of 40 to 50. Air pressure applied to duckbill valve 28 will tend to force open slit 28*a* in the end thereof, allowing air to enter spray cup 26. When pressurized air is removed from the inside of valve 28, the valve closes and thus prevents fluid from passing upwardly out of spray cup 26 into gun body 12.

Figure 4:
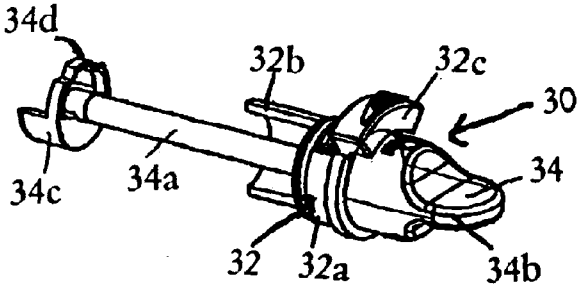
FIG. 4 is a perspective view showing the air valve assembly of the instant invention.
Figure 5:
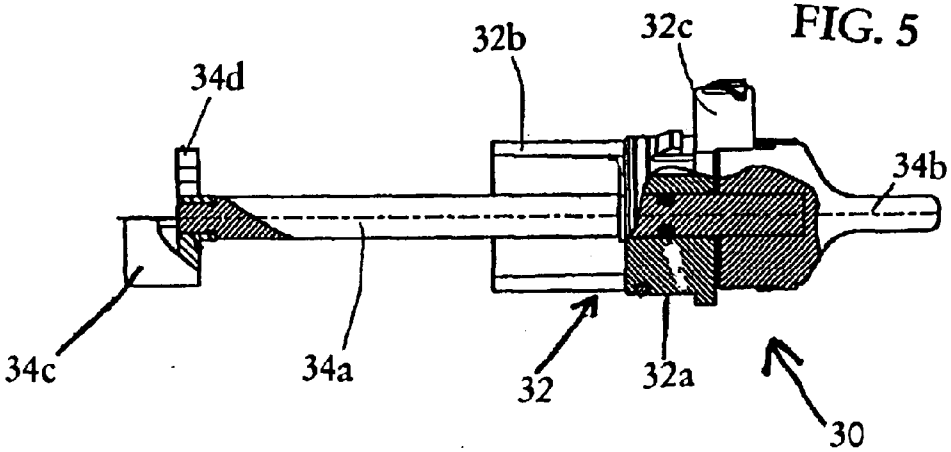
FIG. 5 is a partially cutaway view of the air valve also shown in FIG. 4.

Turning to FIG. 4, the air valve assembly 30 is comprised of a total air valve 32 having sealing and body engaging portion 32*a* and a valve portion 32*b* which are rotatably mounted on a shaft 34*a* of pattern air valve 34 which is further comprised of a handle portion 34*b* and a sealing portion 34*c* having a friction portion 34*d*. Assembly 30 is inserted into a generally cylindrical passageway 12*d* in handle 12 because both portions of valve assembly 30 have frictional engagements (elements 32*a* and 34*d* respectively) each can be operated independently of the other in spite of the fact that one is rotatably mounted on the other. In particular, the pattern handle 34*b* may be used to rotate valve element 34*c* so as to selectively open and close passage 12*e* in body 12. Similarly, handle element 32*c* on total air valve 32 may be used to rotate valve portion 32*b* to selectively open and close aperture 12*b* in body 12. Assembly 30 is merely frictionally engaged in body 12 so that merely by pulling rearward on the assembly, the operator may remove and clean and/or replace valve assembly 30.

Figure 6:
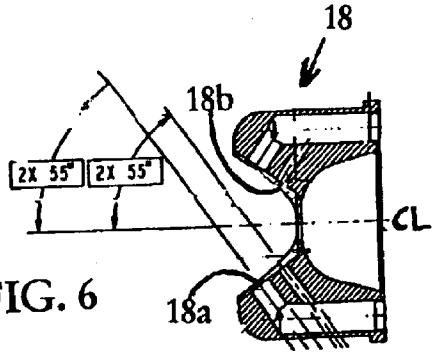
FIG. 6 is the cross-sectional view of the air cap of the instant invention.

As can be seen in FIG. 6, the angle between the centerline CL of the spray gun 10 and the pattern air holes 18*a* and 18*b* in air cap 18 is desirably 55° for best performance.

Figure 7:
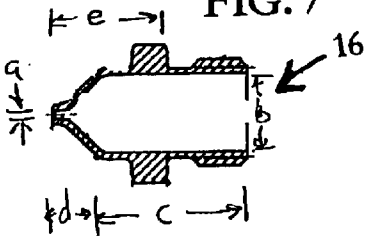
FIG. 7 is the cross-sectional view of the fluid nozzle of the instant invention.
Figure 8:
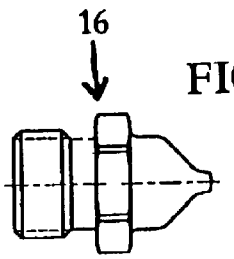
FIG. 8 is a side view of the nozzle also shown in FIG. 7.

The nozzle generally designated 16 in FIGS. 7 and 8 is designed so as to allow different fluid set (needle and nozzle) combinations to provide different flow rates in conjunction with the same air cap. These dimensions are indicated in FIG. 7 and the various combinations are set forth below:

| a | b | c | d | e |
|---|---|---|---|---|
| .032 | .075 | .590 | .200 | .470 |
| .051 | .095 | .590 | .200 | .470 |
| .071 | .120 | .565 | .190 | .436 |
| .087 | .135 | .570 | .180 | .429 |
| .098 | .145 | .565 | .175 | .420 |

Figure 9:
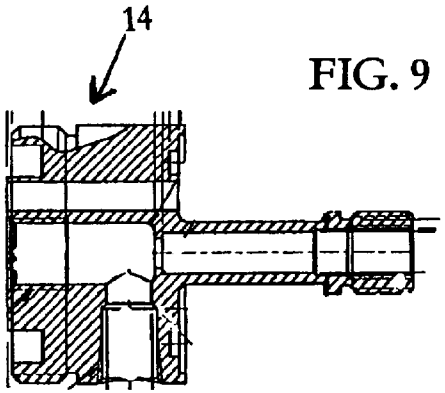
FIG. 9 is a cross-sectional view of the nozzle housing of the instant invention.
Figure 10:
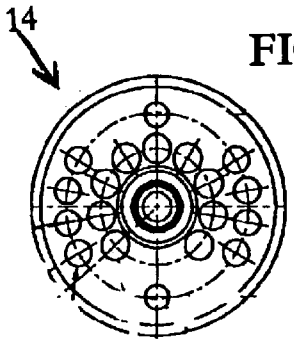
FIG. 10 is a front view showing the air holes in the nozzle housing of FIG. 9.

FIGS. 9 and 10 show the nozzle housing 14 of the instant invention and in particular the hole arrangement (nine 0.1718" holes and eight 0.156" holes) which allows substantial airflow to the air cap in front of the gun with the hole arrangement as set forth.

Figure 11:
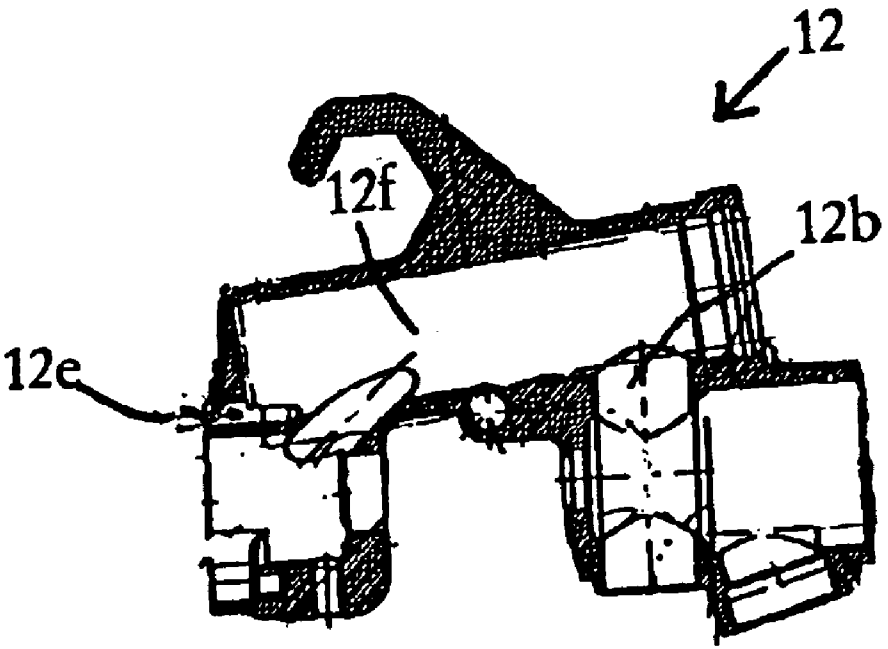
FIG. 11 is a cross-sectional view of the gun body of the instant invention.

FIG. 11 shows the gun body 12 which has a first aperture 12*b* for metering of total airflow through the gun allows air to flow through the nozzle housing and around the outside of the nozzle and the inside of the air cap as well as pattern air aperture 12*e* which may be selectively included by valve element 34*c* to selectively adjust the amount of pattern or fan or shaping air provided in the front of spray gun 10.

It is contemplated that various changes and modifications may be made to the spray gun without departing from the spirit and scope of the invention as defined by the following claims.

What is claimed is:

1. A spray gun having a needle engaging a nozzle and comprising:

a body having front and rear ends and with a generally cylindrical passage therein, said passage having first and second ends, an air inlet adjacent said first end and first and second air outlets adjacent said second end; and an air valve assembly, said valve assembly comprising first and second valve members located in said passage, one of said valve members being located so as to selectively occlude said air inlet and the other of said valve members being located so as to selectively occlude one of said air outlets, said other valve member being remote from said needle and nozzle, said valve members being adjacent to and coaxially rotatable relative to each other and each having a manipulable portion outside the rear of said body.

* * * * *